US008381535B2

(12) United States Patent
Rybaski et al.

(10) Patent No.: US 8,381,535 B2
(45) Date of Patent: Feb. 26, 2013

(54) CONTROL MODULE FOR AUTOMATIC ICE MAKERS

(75) Inventors: John M. Rybaski, Reedsburg, WI (US); Ryan M. Subera, Reedsburg, WI (US)

(73) Assignee: Hankscraft Inc., Reedsburg, WI (US)

( * ) Notice: Subject to any disclaimer, the term of this patent is extended or adjusted under 35 U.S.C. 154(b) by 351 days.

(21) Appl. No.: 12/763,571

(22) Filed: Apr. 20, 2010

(65) Prior Publication Data

US 2011/0000233 A1 Jan. 6, 2011

Related U.S. Application Data

(60) Provisional application No. 61/222,340, filed on Jul. 1, 2009.

(51) Int. Cl.
*F25C 1/00* (2006.01)

(52) U.S. Cl. ..... 62/66; 62/340

(58) Field of Classification Search ..... 62/66, 340, 62/233, 137, 353, 351
See application file for complete search history.

(56) References Cited

U.S. PATENT DOCUMENTS

| | | | | |
|---|---|---|---|---|
| 2,717,504 | A | | 9/1955 | Knerr |
| 3,276,225 | A | | 10/1966 | Linstromberg |
| 3,712,076 | A | | 1/1973 | Fox |
| 3,745,779 | A | | 7/1973 | Bright |
| 4,142,378 | A | | 3/1979 | Bright |
| 4,697,432 | A | | 10/1987 | Cole |
| 4,799,362 | A | | 1/1989 | Chestnut |
| 4,800,731 | A | | 1/1989 | Cole |
| 4,866,948 | A | * | 9/1989 | Cole ..... 62/233 |
| 5,596,182 | A | | 1/1997 | Edwards |
| 5,617,728 | A | * | 4/1997 | Kim et al. ..... 62/71 |
| 5,735,130 | A | | 4/1998 | Lee |
| 5,768,900 | A | | 6/1998 | Lee |
| 5,823,001 | A | | 10/1998 | Patrick |
| 5,839,286 | A | * | 11/1998 | Lee ..... 62/72 |
| 5,881,563 | A | | 3/1999 | Lee |
| 5,889,243 | A | | 3/1999 | Edwards |
| 7,146,820 | B2 | | 12/2006 | Comerci |
| 7,350,369 | B2 | | 4/2008 | Comerci |
| 2006/0174646 | A1 | | 8/2006 | Comerci |

* cited by examiner

*Primary Examiner* — Mohammad Ali
(74) *Attorney, Agent, or Firm* — Boardman & Clark LLP

(57) ABSTRACT

A control module for a refrigerator/freezer wherein the control module drives a rotatable ice ejector for removing ice bodies from a mold of an automatic ice maker in the freezer section of the refrigerator/freezer. The control module has a motor which drives a cam gear which drives the ice ejector. The cam gear comprises a circular gear with a first face and a second face. Once or more cam projections on at least one of the first and second faces are positioned to selectively interact with one or more switches fixedly supported within the control module housing to activate at least one feature of the control module or automatic ice maker rotation of the cam gear.

18 Claims, 14 Drawing Sheets

CONTROL MODULE FOR AUTOMATIC ICE MAKERS

This application claims priority to U.S. Provisional Application 61/222,340, filed Jul. 1, 2009, which is incorporated herein by reference in its entirety.

BACKGROUND

1. Field of the Invention

This invention is related to control modules for automatic ice makers.

2. Related Art

Many modern refrigerator/freezers include automatic ice makers within the freezer section of the refrigerator/freezer. Such automatic ice makers typically include a mold, a source of water and an ejection apparatus. In making ice, the mold, which typically includes multiple semi-circular reservoirs, is filled with water. The water is allowed to freeze, forming ice bodies, referred to herein as cubes. After the water has frozen, the ejection apparatus transfers the ice cubes from the mold into a basin for storage and dispensing.

SUMMARY OF THE DISCLOSED EMBODIMENTS

Typically, the steps of making ice cubes using the above-outlined automatic ice maker are initiated completed and/or controlled using an automatic timing mechanism associated with an ice maker control module. The ice maker control module typically includes a high torque, slow revolving electric motor. In known ice maker control modules, the timing mechanism often includes contact traces behind a timing gear of the control module. These contact traces variously interact with contacts within the control module to complete or close various electrical circuits, thereby powering different mechanisms and/or activating different processes or elements of the automatic ice maker at desired times.

For example, in a typical known ice maker control module, a contact trace behind a timing gear of the ice maker control module may rotate with the timing gear as the timing gear is turned by a motor of the ice maker control module. At a given point in the rotation of the timing gear, the contact trace completes a circuit connected to a water pump or valve, thereby providing a power source or control source to the water pump or valve. In turn, the water pump or valve is activated to provide water to a mold of the ice maker. At a second given point in the rotation of the timing gear, the completed circuit to the water pump or valve is broken and the water pump or valve ceases to provide water to the mold.

However, the physical interaction between the contact traces and contact points within the control module may create a problematic wear point. In various known ice maker control modules, the contact traces eventually catch on structures behind the timing gear and bend or distort. The bent or distorted contact traces are not effective at maintaining accurate timing of the operation of the control module. For example, if a contact trace is bent, it may not make contact with one or more contact points of the control module at the expected point in the rotation of the timing gear. As such, the operation associated with that contact point may be disturbed (e.g., the operation may begin earlier or later than expected) and the overall operation of the automatic ice maker is changed. Likewise, a bent or distorted contact trace may inhibit the rotation of the timing gear and/or cause other malfunctions.

Similarly, the contact traces and/or contact points within the control module may deteriorate due to corrosion. As such, the electrical connection between the contact traces and the contact points within the control module may decrease over time (e.g., the electrical interaction between the contact trace and the contact points may become more resistive).

Additionally, the contact traces behind the timing gear are not easily accessible to a repair technician and thus cannot be easily repaired, cleaned or replaced if they are malfunctioning. Often, in typical known ice maker control modules, it is easier for the repair technician to simply replace the entire control module, rather than attempt to repair or clean any damage to the contact traces. Accordingly, simple damage to the contact traces may often result in a costly replacement of the entire control module.

In various exemplary embodiments of the present invention, a control module for an automatic ice maker includes a cam gear that includes several projecting cams on one or more surfaces of the cam gear. The cam gear is rotated by a spur gear driven by the motor of the control module. As the cam gear rotates, the several projecting cams interact with electrical switches within the control module to complete various electrical circuits of the control module. In various exemplary embodiments, the various electrical circuits and switches may initiate, power, and terminate and/or control operation of the motor driving the cam gear, a heating element, a bail wire rotation unit, an ejection apparatus of the automatic ice maker and a water pump or valve to provide water to a mold of the ice maker.

In various exemplary embodiments, a control module for an automatic ice maker includes a cam gear that includes at least one projecting cam. The cam gear is rotated by a spur gear driven by a motor of the control module. As the cam gear rotates, the at leak one projecting cam interacts with a transfer lever arm, which in turn interacts with at least one electrical switch within the control module to complete one or more electrical circuits of the control module. In various exemplary embodiments, the one or more projecting cam and/or the transfer lever arm are positioned, shaped, and/or otherwise designed to encourage the motor to stall under exceptional circumstances.

In various exemplary embodiments, a control module for an automatic ice maker interacts with a thermostat having a temperature sensor located in proximity to a mold of the automatic ice maker. When the temperature sensor reaches a temperature that corresponds to a temperature of the mold which is sufficiently cold to indicate that the water within the mold has frozen the thermostat switch closes to activate a motor of the control module to rotate a cam gear, and also activates a heating element of the automatic ice maker. The heating element raises the temperature of the mold, separating the margins of the frozen ice from the mold as the cam gear rotates. In various exemplary embodiments, such activation of the motor and heating element initiates the operating cycle of the control module and automatic ice maker apparatus.

In various exemplary embodiments, the cam gear continues to rotate at a speed to provide a timing mechanism for the operating cycle of the ice maker components. Eventually (e.g., at a given point in the rotation of the cam gear), the one or more projections of the cam gear will stop interacting with a first motor switch to turn on that normally closed switch and directly power the motor.

In various exemplary embodiments the thermostat will reach a predetermined temperature and shut off power to the motor and the heating element. The motor and cam gear will continue constant speed rotation under control of the motor switch.

In various exemplary embodiments, at another point in the rotation of the cam gear an ejector apparatus is coupled to and rotationally driven by the cam gear. In various exemplary embodiments, the ejector apparatus is driven through the ice maker mold to eject the frozen ice cubes from the mold into an ice storage compartment.

In various exemplary embodiments, the cam gear continues to rotate. Eventually (e.g., at a given point in the rotation of the cam gear), the one or more projections of the cam gear will interact with a water fill switch and circuit to activate a water pump or valve of the automatic ice maker. The water pump or valve, when activated, provides water to fill the emptied mold cavities of the automatic ice maker. In various exemplary embodiments, as the cam gear continues to rotate the one or more projections will stop interacting with the water fill switch and circuit and the water pump or valve will be deactivated after filling the mold cavities.

It should be appreciated that the above-outlined interaction between the one or more projections of the cam gear and the various switches may be essentially instantaneous (e.g., one or more of the projections depresses a plunger of a switch but does not hold the plunger down for a considerable amount of time) or may continue over a given period of the rotation of the cam gear (e.g., one or more of the projections may be provided over a given arc of the cam gear such that it interacts with a switch over a given period of rotation of the cam gear). It should also be appreciated that the various points or periods of interaction between the one or more projections and the motor, water fill and other switches may overlap. However, certain functions controlled by the switches, which in turn are controlled by the cam gear projections, will be in timed sequence for effective sequential operation of the ice maker components.

In various exemplary embodiments, the one or more projections of the cam gear will interact with each of the switches at least once during a full 360 degree rotation of the cam gear. In various exemplary embodiments, the cam gear includes three cams and each cam is associated with one of the switches to activate and deactivate that switch at given points, or over a given arc, of the rotation of the cam gear. In various exemplary embodiments, one or more of the projections are provided on a first face of the cam gear and the rest of the projections are provided on an opposite face of the cam gear. In various exemplary embodiments, one or more projections are provided at different elevations or spacing than any other projections on the same face of the cam gear.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF DRAWINGS

Various exemplary embodiments of the systems and methods according to this invention will be described in detail, with reference to the following figures, wherein.

DETAILED DESCRIPTION OF EXEMPLARY EMBODIMENTS

Figure 1:
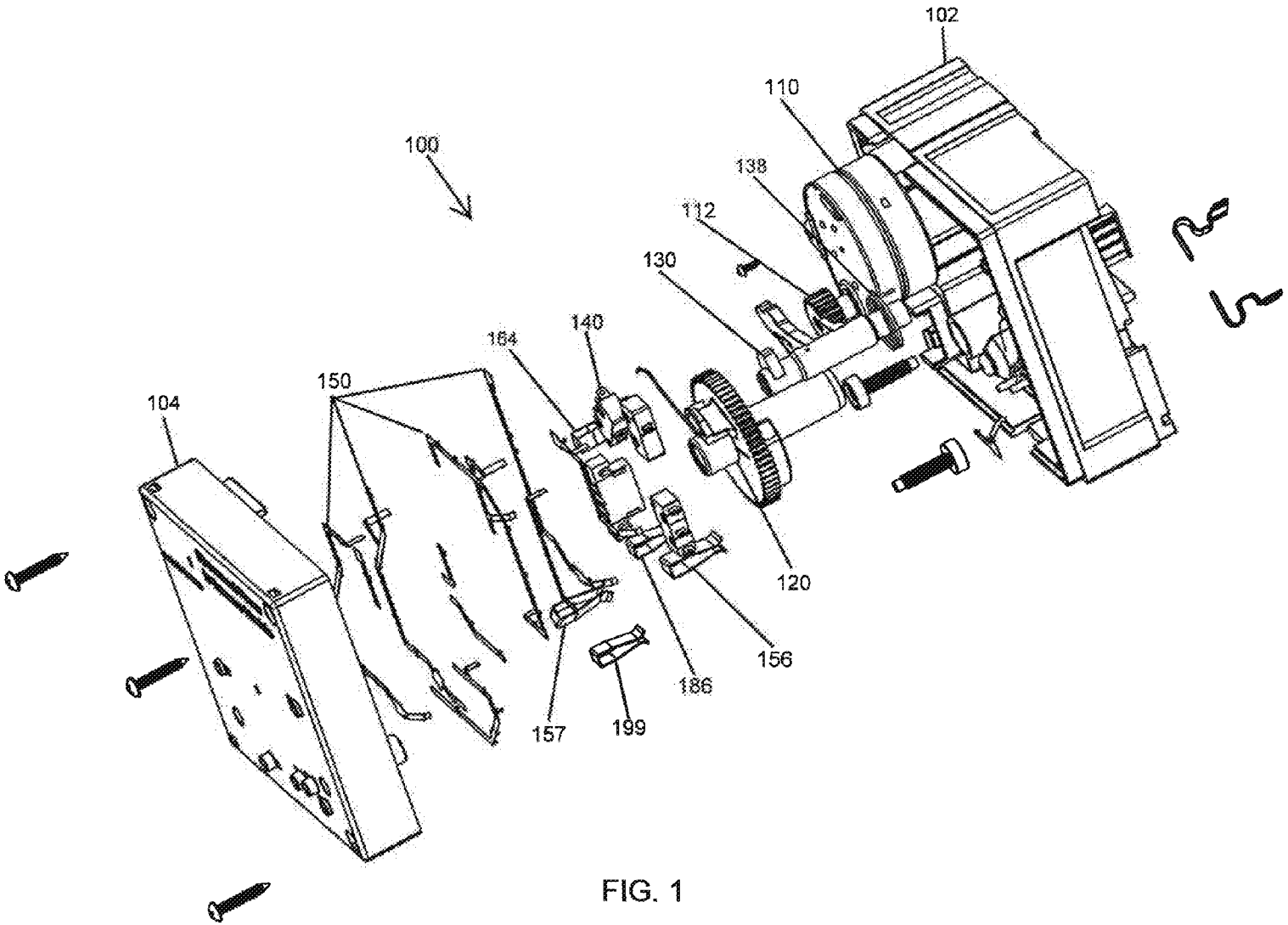
FIG. 1 is an exploded isometric view of a control module according to exemplary embodiments.

As outlined above, automatic ice makers typically include a control module for controlling the various operations of the ice maker in the process of making ice. The control module is typically electrically or mechanically connected, coupled or otherwise interacts with a mold, a water pump or valve, a heating element, an ejection apparatus and/or other components of the automatic ice maker. In various exemplary embodiments, the control module is operated in reaction to a temperature sensor indicating that the mold contains water that has been cooled to a sufficient temperature (e.g., the water has been frozen to form ice cubes).

It should be appreciated that, while the frozen water bodies within the mold may be referred to as ice cubes, in various exemplary embodiments, the frozen water is not cubed shaped. For example, the frozen water may have a molded semi-circular or other convex bottom surface, or any other suitable or desired shape for the formation and mold release of the ice cubes.

In various exemplary embodiments, when the temperature sensor of a thermostat indicates that the temperature of the water has reached a sufficiently low level (e.g., the water has frozen), a motor is activated by the thermostat. In various exemplary embodiments, the thermostat may also activate a heater to warm the mold surface to disengage the frozen ice cubes from the mold surfaces. It should also be appreciated that the above-outlined heating element may be any suitable heating element and/or any other suitable known or later-developed element that is usable to separate the ice cubes from a mold of the automatic ice maker. In various exemplary embodiments, the heating element is an electrical heating element that heats the mold and/or the ice cubes to separate the ice cubes from the mold. In various other exemplary embodiments, the heating element is a water pump or valve that circulates water to the mold and/or to the ice cubes to raise the temperature of the mold and/or the ice cubes, thereby separating the ice cubes from the mold.

The motor rotates a gear that interacts with a cam gear to rotate the cam gear. It should be appreciated that the interaction between the gear driven by the motor and the cam gear may be utilized to alter the relative rotational speed of the cam gear in relation to the motor. For example, the cam gear may be larger in diameter than the gear driven by the motor such that the cam gear rotates at a slower radial velocity than the motor. In various exemplary embodiments, the cam gear includes one or more projections on one or more faces of the cam gear. For example, the cam gear may include two projections on a front face of the cam gear and one projection on a rear face of the cam gear. It should be appreciated that, in various exemplary embodiments, the cam gear may include any desired number of projections, including no projections, on either face of the cam gear.

In various exemplary embodiments, each projection of the cam gear interacts with one or more switches of the control module. In various exemplary embodiments, each projection is associated with a switch such that each projection interacts with only one switch and each switch interacts with only that projection. However, it should be appreciated that, in various exemplary embodiments, one or more projections may interact with one or more switches and/or one or more switches may interact with one or more projections. As such, in various exemplary embodiments, there may be more or fewer switches than projections and vice versa. Additionally, in various exemplary embodiments, one or more of the projections may interact with one or more switches through an intermediate mechanical element. For example, in various exemplary embodiments, one or more of the projections may interact with (e.g., deflect) a bail wire lever, which in turn interacts with one or more switches.

The switches are electrically connected to various traces and/or electrical contacts of the control module and may be electrically connected to various elements of the automatic ice maker outside of the control module. For example, in various exemplary embodiments, one such switch may be connected to an electrical trace that connects to a heating element via a suitable known or later-developed contact or interface. In various exemplary embodiments, one or more electrical traces and/or contacts of the control module are connected to an electrical interface provided through a housing of the control module (e.g., a silo-type connector). In various exemplary embodiments, various elements of the automatic ice maker are connected to the control module via the electrical interface such that they are in electrical communication with one or more of the electrical traces of the control module.

FIG. 1 shows an exemplary embodiment of a control module 100 for an ice maker according to this invention. As shown in FIG. 1, the control module 100 includes a molded plastic housing 102 and a cover 104. In an exemplary embodiment, the housing 102 and cover 104 may be polyvinylchloride (PVC) or any other moldable plastic of comparable strength, durability and electrically non-conductive properties. The housing 102 and the cover 104 enclose and position various other components of the control module 100. In the exemplary embodiment shown in FIG. 1, the housing 102 and the cover 104 enclose a motor 110, a spur gear 112 driven by the motor 110, a cam gear 120 driven by the spur gear 112, a bail wire lever 130, one or more switches 140 having protective housings, and various electrical circuits, traces and/or contacts 150.

In various exemplary embodiments, the motor 110 is a high torque, slow rotation electric motor. For example, the motor 110 may be a 3-watt motor that provides approximately 90-110 inch-ounces of torque. In various other exemplary embodiments, the motor 110 may be a low torque electric motor. For example, the motor 110 may be a 1.5-watt motor that provides approximately 40-55 inch-ounces of torque. In various other exemplary embodiments, the motor 110 is a mid-torque electric motor. For example, the motor 110 may be a 3-watt motor that provides approximately 70 inch-ounces of torque. It should be appreciated that the motor 110 may be any suitable known or later-developed motor that provides any desired combination of torque and rotation speed. Additionally, the motor 110 may include any known or later-developed gear(s) and/or the like.

Figure 2:
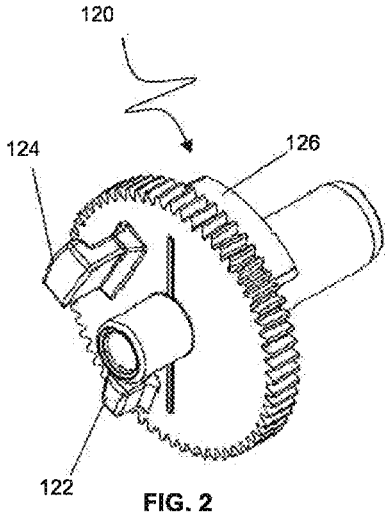
FIGS. 2-3 are isometric and plan views, respectively, of a cam gear according to an exemplary embodiment.
Figure 3:
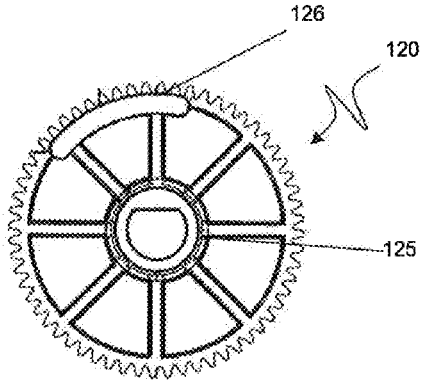

FIGS. 2 and 3 show isometric plan views of the cam gear 120 of an exemplary embodiment of the invention. In an exemplary embodiment of the invention, the cam gear 120 may be molded polyoxymethylene (POM) or other moldable plastic material of comparable strength and durability. As shown in FIG. 2, the cam gear 120 includes first and second cam projections 122 and 124, respectively, on a first or front face of the cam gear 120,and a third cam projection 126 on a second or rear face of the cam gear 120. In the exemplary embodiment shown in FIGS. 2, each projection 122 and 124 of the front face of the cam gear 120 is associated with a corresponding switch 140 of the control module 100.

As such, the projections 122 and 124 are designed such that they will not interact with the same switch 140. It is noted that in the exemplary embodiment shown in FIGS. 2 and 3, the first projection 122 and the second projection 124 are provided at similar radii from the center of the cam gear 120. That is, the surface of the first projection 122 that interacts with a switch 140 and the surface of the second projection 124 that interacts with another switch 140 are each located at similar distances from the center of the cam gear 120. To prevent the first projection 122 and the second projection 124 from interacting with the same switch 140, the second projection 124 is provided at a different spacing, relative to the spacing of the first projection 122, from the front face of the cam gear 120. Thus, the first projection 122 and the second projection 124 have separate, unique paths of travel at least at the surface that interacts with the switches 140.

It should be appreciated that in various exemplary embodiments, one or more projections may interact with more than one switch and/or one or more switches may interact with more than one projection. It should also be appreciated that the size and shape of the projection may correlate to the desired operation (e.g., the relative time period of activation) of a corresponding switch. For example, the size of the arc of the cam gear 120 that is occupied by the second projection 124 may be related to a desired length of operation of the switch 140 that is associated with the second projection 124. That is, the cam gear 120 will rotate at a known speed, as such, the size of each projection 122-126 will result in a known relative length of interaction and/or operation of a corresponding switch 140.

As outlined above, in the exemplary embodiment shown in FIGS. 2 and 3, each projection 122-126 will interact with a single corresponding switch 140. As such, each projection 122-126 has a unique path of travel, within which the corresponding switch is located. If the path of travel of one projection were the same as that of another projection, or if they sufficiently overlapped and/or were too close to each other, the projections may either interact with the same switch(es) or one or more of the switches may interfere with the rotation of the cam gear 120.

As shown in FIG. 3, the third projection or cam 126 has a unique path of travel on the rear face of the cam gear 120. Likewise, as shown in FIG. 2, the first projection 122 and the second projection 124 have unique paths of travel that are at similar radius but at different distances from the front face of the cam gear 120. It should be appreciated that the second projection 124 is roughly L-shaped such that a support portion of the second projection 124 is at a smaller radius than the outer most surface of the first projection 122, while the extending portion of the second projection 124 is at a similar radii but a different spacing from the front surface of the cam gear 120. As such, the support portion of the second projection 124 will not interact with the switch 140 that is associated with the first projection 122.

Figure 4:
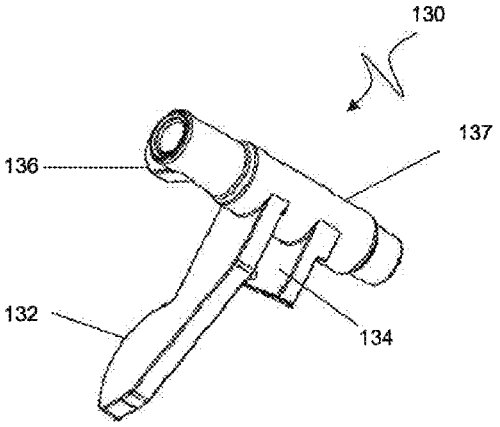
FIG. 4 is an isometric view of a bail wire lever according to an exemplary embodiment.

FIG. 4 shows an isometric view of a first exemplary embodiment of the bail wire lever 130, which in an exemplary embodiment may be formed of POM or functionally comparable material. The bail wire lever 130 includes an actuation arm 132, a biasing arm 134, a switch interface projection 136, and a hub portion 137. The actuation arm 132 interacts with the third projection 126 of the cam gear 120 to actuate the bail wire lever 130 at a given point or over a given arc of the rotation of the cam gear 120. When the bail wire lever 130 is actuated, the bail wire lever 130 rotates about its axis. At a given point of that rotation, the switch interface projection 136 interacts with a switch 140 of the control module 100. As such, at a given point, or during a given arc, of the rotation of the can gear 120, the third projection 126 interacts, through the switch interface projection 136 of the bail wire lever 130, with a corresponding switch 140.

It should be appreciated that, in general, the bail wire lever 130 is biased such that it will pivotally return to its original or "home" orientation when the third projection 126 is no longer interacting with the actuation arm 132. In the exemplary embodiment shown in FIG. 5, the bail wire lever 130 is biased via a spring 138, such as, for example, a coil spring (shown in FIG. 1), that interacts with the housing 102 and the biasing arm 134 of the bail wire lever 130.

Figure 5:
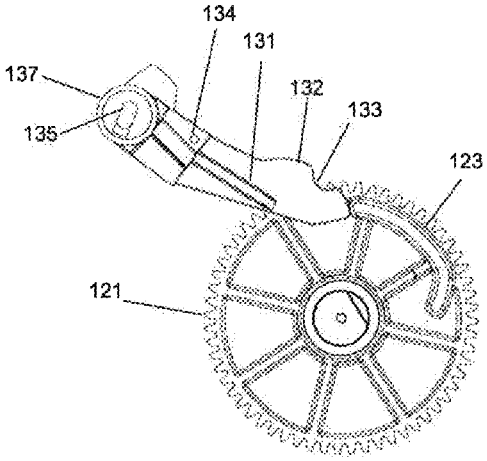
FIGS. 5-6 are rear plan views of a cam gear interacting with a bail wire lever according to a second exemplary embodiment.

FIG. 5 shows a rear plan view of a cam gear 121 according to a second exemplary embodiment. As shown in FIG. 5, the cam gear 121, in various exemplary embodiments, may include a third projection 123, projecting from the rear face of the cam gear 121, that has a curved-L shape. That is, the third projection 123, has a first portion that extends arcuately at a constant outer radius from the axis of rotation of the cam gear 121 near the outer circumference of the cam gear 121, while the remaining portion of the third projection 123 has a diminishing radial distance from the cam gear 121 axis of rotation such that it is directed toward the interior of the rear face of the cam gear 121. It should be appreciated that the third projection 123 may have other shapes and/or configurations to alter the way, moment and/or length of time that the third projection interacts with the bail wire lever 131 and/or one or more switches 140.

Figure 6:
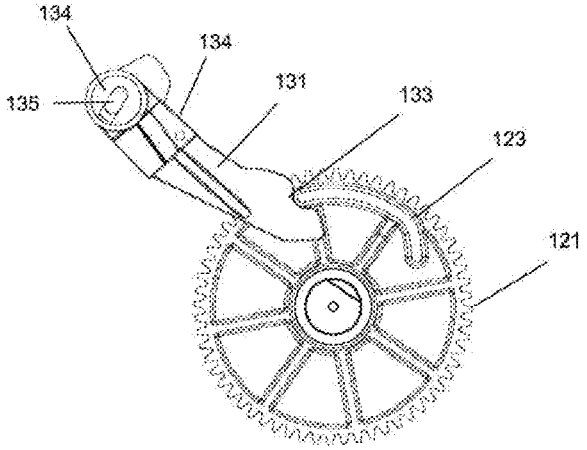
Figure 8:
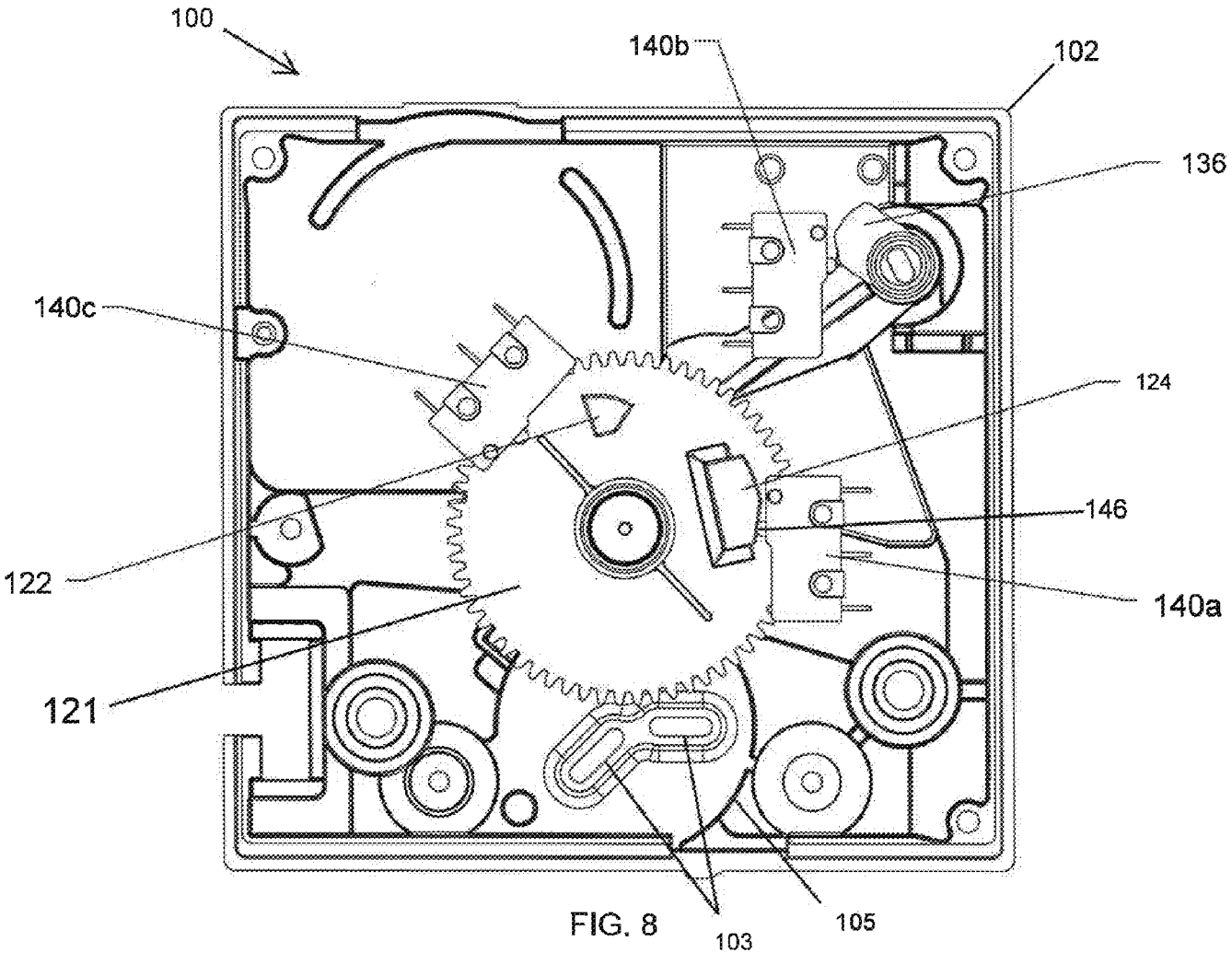
FIG. 8 is a front plan view of a partially assembled control module housing according to an exemplary embodiment wherein the cam gear and other illustrated elements are shown in their home position prior to the beginning of an operating cycle.

FIGS. 5 and 6 are rear plan views of the cam gear 121 of FIG. 8 shown at various stages of interaction with a bail wire lever 131 according to a second exemplary embodiment. As shown in FIG. 5, the second exemplary bail wire lever 131 includes a notch or cutout 133 in its actuation arm 132. As the cam gear 121 rotates counterclockwise (as viewed in FIGS. 5 and 6) it meets the actuation arm 132 at the point below the notch or cutout 133, as shown in FIG. 5. It should be appreciated that, in various exemplary embodiments, the bail wire lever 131 is connected to or interacts with other moving structures of the ice maker. For example, in various exemplary embodiments, the bail wire lever 131 may interact with a wire bail arm 135 keyed or otherwise fixedly coupled within the hub portion 137 of the lever 130 or 131. The wire bail arm 135 will extend from the hub 137 outwardly through an opening in the control module housing 102 into an ice making compartment within a freezer section of a refrigerator/freezer (not shown), and moves through an arc, defined by the arcuate movement of the bail arm lever 131, between a lower position lying within an underlying deep tray-like ice reservoir (not shown) to detect an elevated level of ice cubes within the reservoir, and an upper position normally above the level of the walls of the reservoir to facilitate the unimpeded gravitational flow of ejected ice cubes into the reservoir from the ice cube mold (not shown), and removal and insertion of the reservoir within the ice making compartment. Conversely, in various exemplary embodiments, the wire bail arm may 135 prevent, inhibit or limit the rotation of the lever arm 131 when movement of the coupled wire bail arm is obstructed by frozen ice or a surplus level of ice cubes within the reservoir.

In such exemplary embodiments, the lever 131 may, under operating conditions, be impeded and prevented or inhibited from rotating through its full arcuate path and/or limited to a certain range of rotation when the reservoir is sufficiently full of ice cubes or rigidly frozen ice bodies to block the path of the ice bail arm 135 between its upper and lower positions. For example, as shown in FIG. 6, as the cam gear 121 continues to rotate, if under very unusual circumstances, the wire bail arm 135 should become lodged in place between frozen ice cubes or frost within the ice reservoir, the lever 131 may be prevented from rotating to full deflection and instead rotate only partially, or not at all, to obstruct the continued movement of the third projection 123 and the cam gear 121. As shown in FIG. 6, as the cam gear continues to rotate, the third projection 123 enters, grasps or otherwise interacts with the notch or cutout 133 of the lever 131. In various exemplary embodiments, the interaction between the third projection 123 and the notch or cutout 133 of the impeded lever 131 increases the torque necessary to continue the rotation of the cam gear 121. As such, when the third projection 123 sufficiently interacts with the cutout or notch 133, the motor 110 that drives the cam gear 121 may desirably stall with the cam gear 121 in the position shown in FIG. 6, and thus prevent the further rotation of the cam gear 121. In this way, when a wire bail arm or other structure is interacting with the lever 131 to prevent, inhibit or limit the rotation of the lever 131, the motor 110 will stall and the ice maker module 100 will effectively stop making more ice until the ice making compartment of the refrigerator/freezer is accessed to remove the ice blockage.

Figure 12:
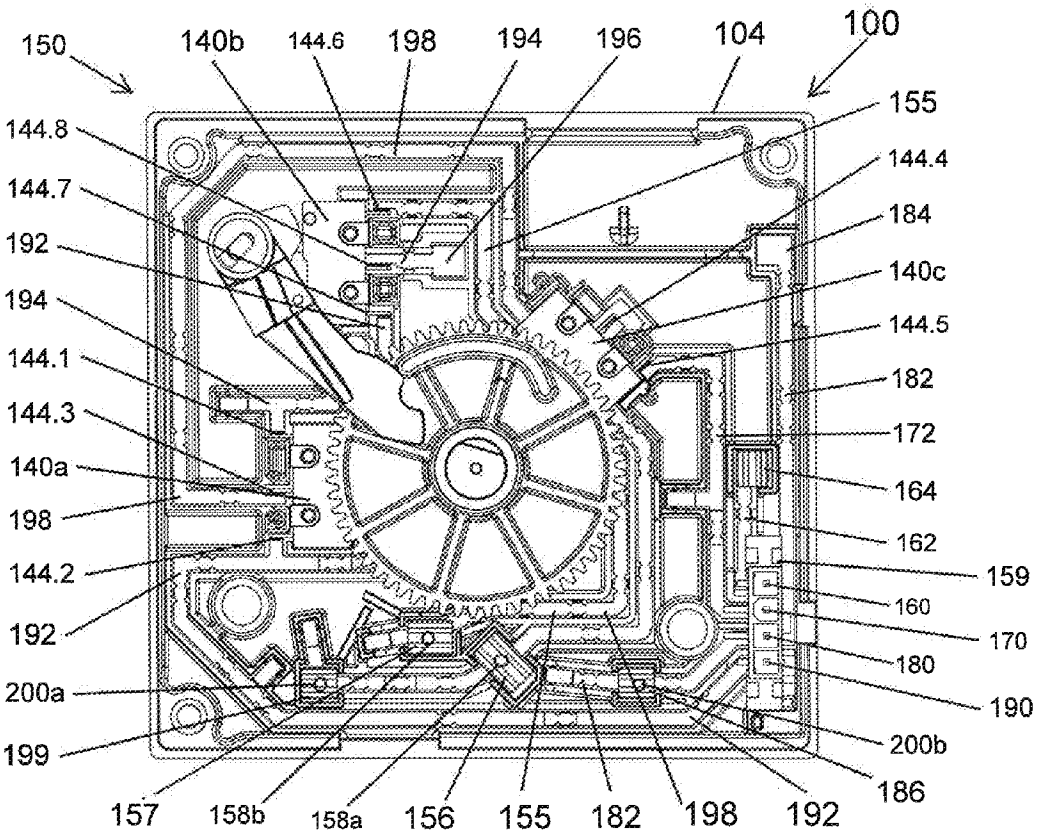
FIG. 12 is a rear plan view of a cover of a partially assembled control module illustrating the position of selected components, including electrical circuit components, at the time of bail arm lever switch engagement.
Figure 13:
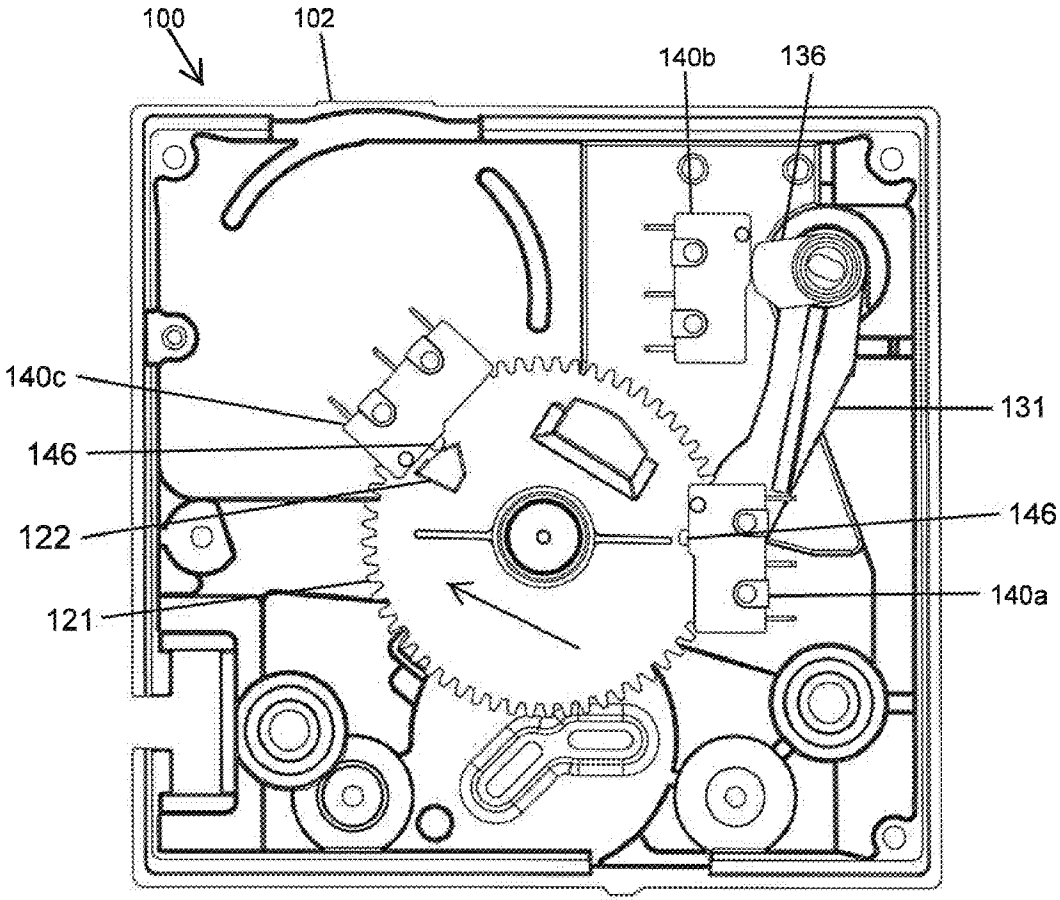
FIG. 13 is a front plan view of a partially assembled control module housing illustrating the position of selected components at the time of activation of the water fill step according to an exemplary embodiment.
Figure 14:
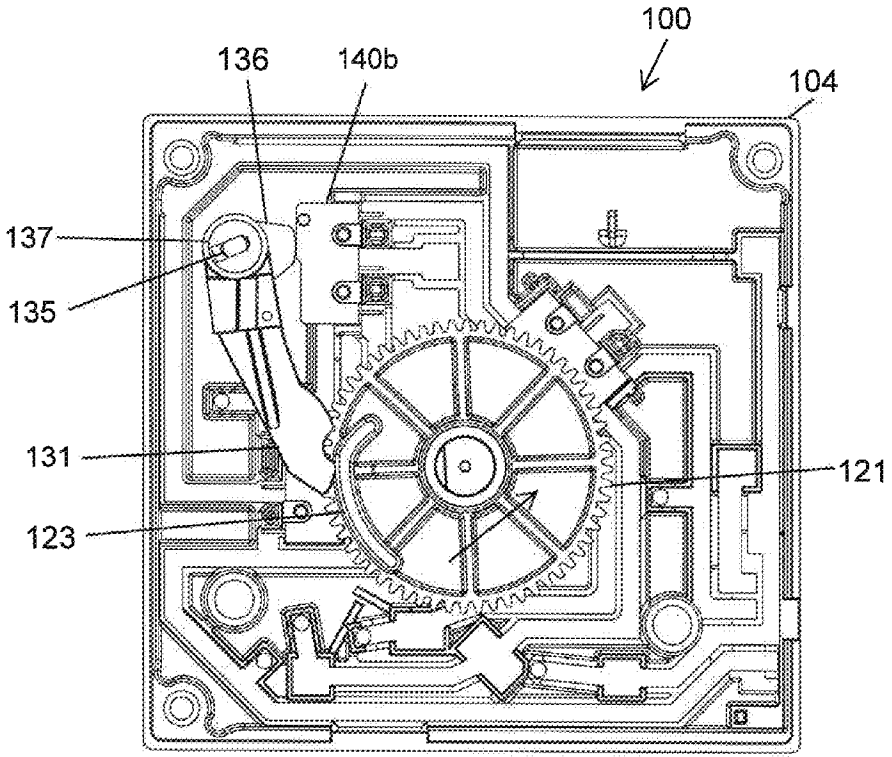
FIG. 14 is a rear plan view of a cover of a partially assembled control module illustrating the position of selected components during the water fill step and bail arm lever switch engagement according to an exemplary embodiment.

As shown in FIG. 14, when the ice wire arm 135 is not interacting with other structures that prevent, inhibit or limit its rotation, the coupled lever 131 is free to rotate to full deflection as it interacts with the third projection 123. As shown in FIGS. 12 and 14, when the lever 131 has been sufficiently deflected by the third projection 123, the switch interface projection 136 interacts with switch 140*b* to deactivate that switch. As shown in FIG. 13, as the cam gear 121 continues to rotate, the third projection 123 will eventually pass by and stop interacting with the lever 131. In various exemplary embodiments, when the rearward portion of third projection 123 drops away from a circumferential position toward a position of lesser radius from the axis of rotation of the cam gear 121, and has passed by and is no longer interacting with the lever 131, the lever 131 will return to its undeflected home position, such as by being biased with a spring described above with regard to the lever 130 of the first exemplary embodiment. When the lever 131 returns to its undeflected position, as shown in FIG. 16, the switch interface projection 136 will cease interacting with the button plunger 146 of the switch 140*b*, and the switch 140*b* will no longer be activated.

Figure 16:
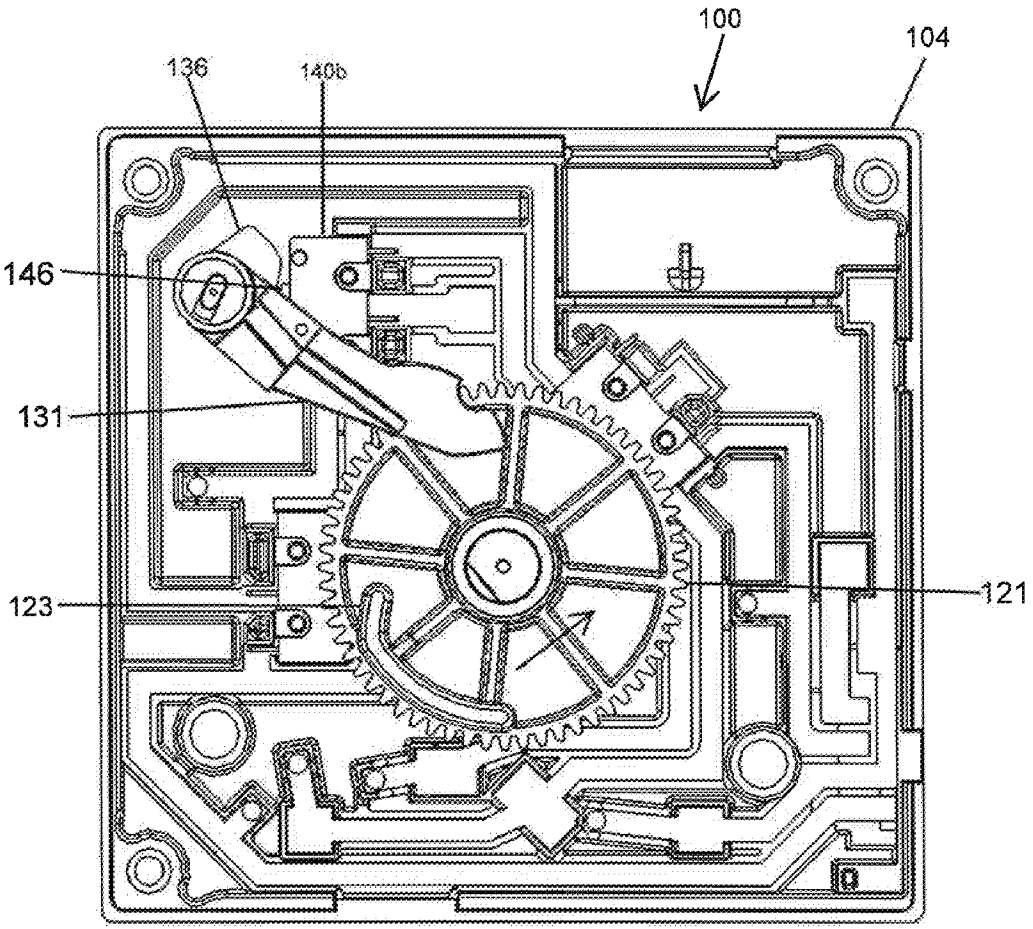
FIG. 16 is a rear plan view of a cover of a partially assembled control module showing the bail wire lever returned to its home position and disengaged from the bail arm lever switch after its disengagement by the cam gear bail wire lever cam.

It should be appreciated that, while the notch or cutout 133 is shown in FIGS. 5 and 16 as a generally semicircular cutout from the lever 131, the notch or cutout 133 may take any desired shape. In various exemplary embodiments, the notch or cutout 133 is designed, shaped or otherwise provided such that it will improve the interaction between the lever 131 and the third projection 123 to increase the torque necessary to continue the rotation of the cam gear 121 and free the bail arm 135 from light ice cube interferences.

Figure 7:
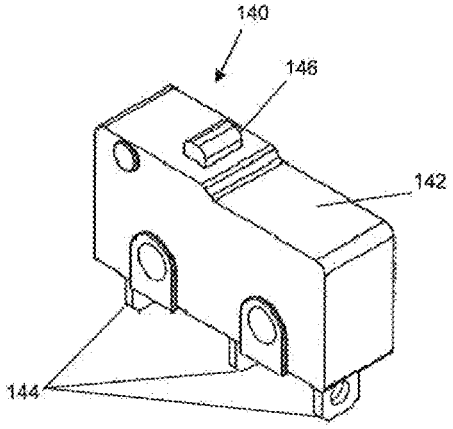
FIG. 7 is an isometric view of a switch according to a second exemplary embodiment.

FIG. 7 shows an exemplary embodiment of an electrical switch 140 that may interact with one or more of the cam projections 122, 124 or 136. As shown in the exemplary embodiment of FIG. 7, the electrical switch 140 may be a push button switch that includes a protective housing 142, contacts 144 and a movable actuator such as a button plunger 146 which extends externally of the protective housing for interaction with at least one cam extending from a cam gear face. When the plunger 146 of such a switch 140 is depressed by any one or another of the cam projections 122, 124 or 136, an electrical circuit is completed or broken between two or more of the contacts 144. It should be appreciated that the switch 140 may be any suitable known or later developed switch. For example, the switch 140 may be a single pole, single throw switch or a single pole, double throw switch. Likewise, the switch 140 may be a reed switch, a capacitive switch, a touch sensor or any other known or later-developed device that can be externally actuated by suitable structures at desired points and/or over desired arcs of the rotation of the cam gear 120. In addition, the switch 140 may be configured to be normally open or normally closed, whereby actuation of the switch may make and/or break a circuit controlling the flow of power to a component of the system.

Figure 11:
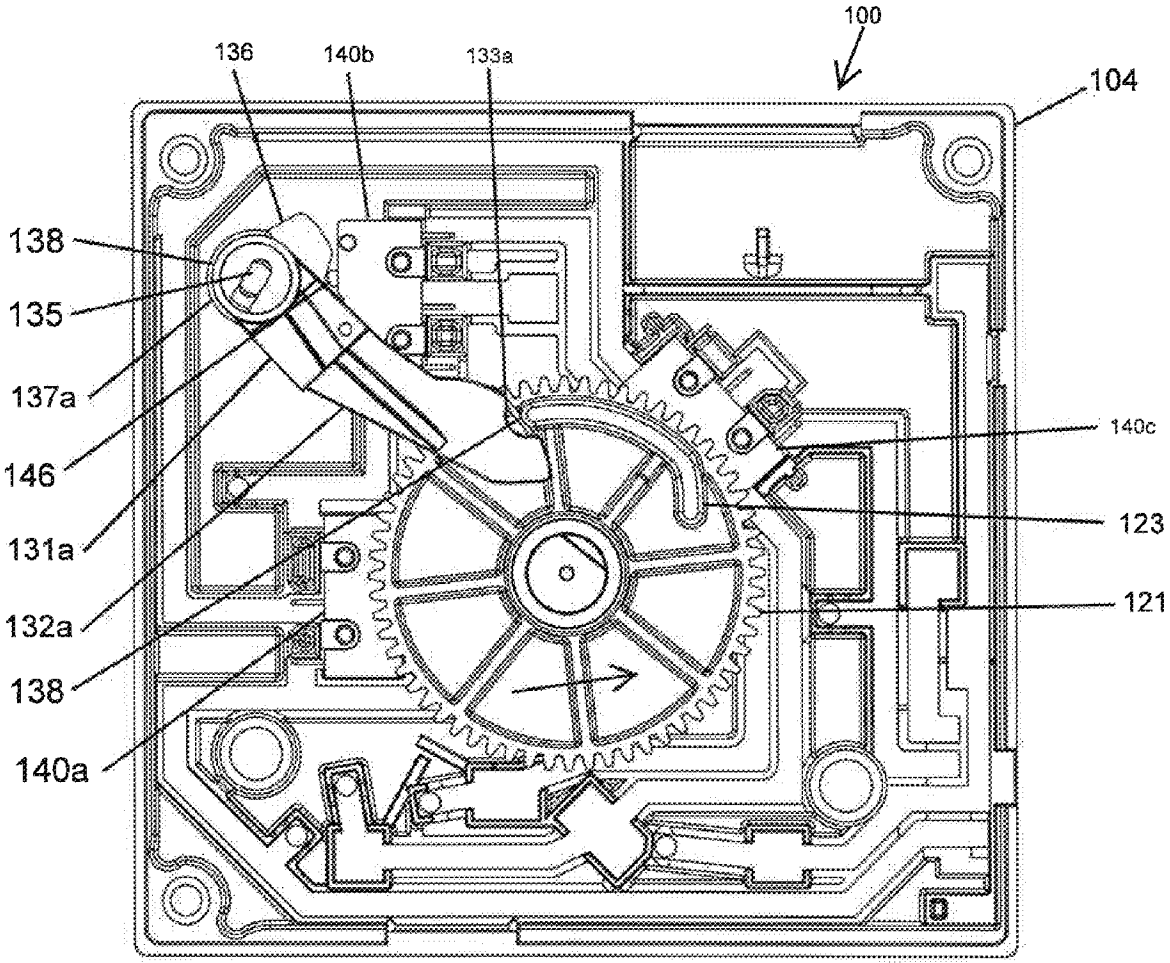
FIG. 11 is a rear plan view of a cover of a partially assembled control module according to a third exemplary embodiment wherein the cam gear bail wire lever cam is shown engaged with a bail wire lever according to a third exemplary embodiment.
Figure 15:
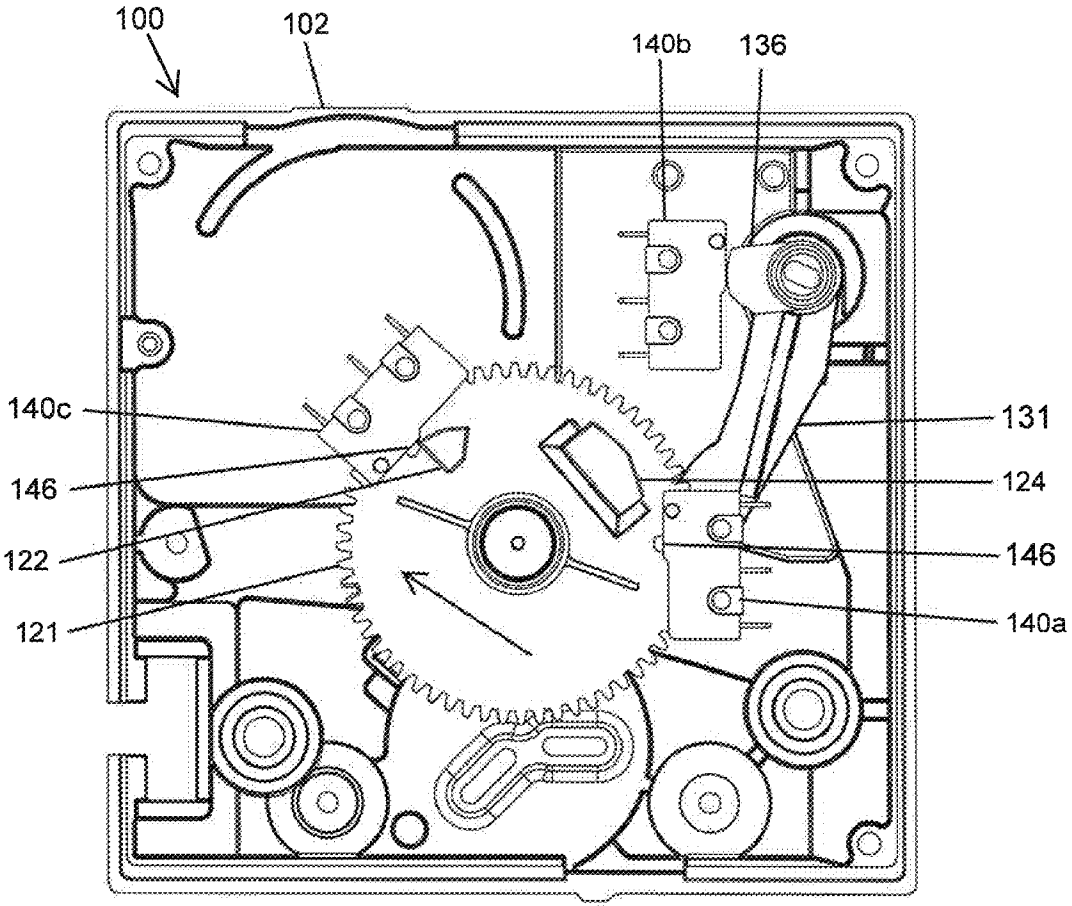
FIG. 15 is a front plan view of a partially assembled control module housing illustrating the position of selected components at the time of deactivation of the water fill step according to an exemplary embodiment.

FIG. 11 shows a partially assembled control module 100 which includes having a bail wire lever 131*a* according to a third exemplary embodiment. As shown in FIG. 15, the third exemplary bail wire lever 131*a* includes a modified notch or cutout 133*a* in its actuation arm 132*a*. A resilient bail arm lever wire clip 138, extends from the hub portion 137*a* along the front hidden portion of the actuation arm 132*a*, and across the notch or cutout 133*a* to provide a smooth interface between the leading portion of the cam gear third projection 123 and the actuation arm 132*a*. Thus, under normal operating conditions the bail wire lever 131*a* is free to rotate in response to contact by the cam gear third projection 123, without resistance from the wire bail arm 135, and the third projection 123 will engage the clip 138 which will smoothly follow the moving cam toward and through the position shown for the lever 131 in FIG. 12. During such movement, switch interface projection 136 will interact with the button plunger 146 to cause normally closed switch 140*b* to be opened in the usual manner.

On the other hand, if the lever 131*a* is impeded and prevented from rotating through its full arcuate path because the coupled wire bail arm 135 has become lodged or frozen in place within the ice reservoir to prevent movement of the coupled lever 131*a*, the resilient bail arm lever clip 138 is designed to deform to permit the leading end of cam gear projection 123 to extend into the notch or cutout 133*a* of the actuation arm 132*a* until the resistance of the bail arm lever 131*a* forces the cam gear 121 to stop its rotation and motor 110 to stall with lever 131*a* in approximately the position shown in FIG. 11. Accordingly, the bail arm lever clip 138 will facilitate a smooth interface between the gear cam third projection 123 and the actuation arm 132*a* of bail wire lever 131*a*, while also protecting the notch 133*a* portion of the actuation arm 132*a* from any wear which might otherwise be caused by the rotating third projection 123 of the gear cam 121. After such an ice impediment to the wire bail arm 135 is subsequently removed, the wire bail arm 135 will again be free to move in response to the action of the bail wire lever 131*a* due to resumed operation of the motor 110 and the resulting movement of third projection 123 of the gear cam 121. The module 100 and ice maker apparatus will then return to their normal ice ejection/water fill cycle.

Figure 9:
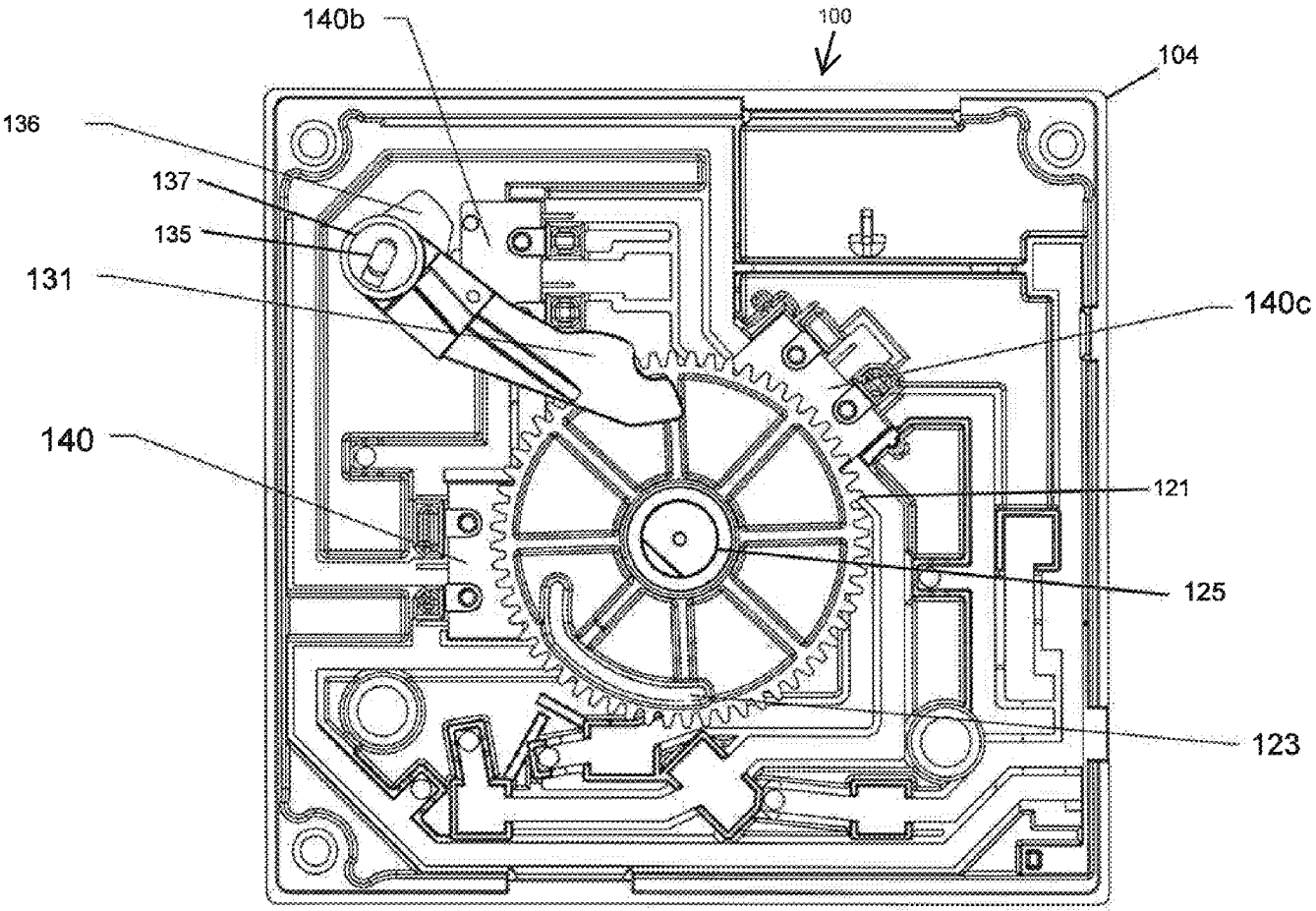
FIG. 9 is a rear view of the cover of a partially assembled control module illustrating the positions of various components when the components are in their home position.

The operation of an exemplary embodiment and method of the present invention, during a single cycle of the control module, can be best understood by reference to FIGS. 8-17. FIG. 8 is a front interior plan view of a partially assembled control module 100 and control module housing 102, wherein motor switch 140*a*, bail arm lever switch 140*b* and water fill switch 140*c*, which switches are fixedly located within the cover 104 as shown in FIG. 9, have been schematically superimposed in FIG. 8 in their working positions in alignment within motor switch cam 124, bail arm lever switch cam 136 and water fill switch cam 122, respectively. The switches 140*a*, 140*b* and 140*c* are similarly illustrated in FIGS. 10, 13 and 15, which will be referenced below. FIG. 8 illustrates the module 100 in its "home" position, wherein the motor switch cam has engaged the button plunger 146 to open the normally closed motor line circuit path through motor switch 140*a* and break the circuit supplying power to the motor, thereby causing the cam gear 121 to stop in its illustrated home position. The unit will remain in its home position while the freezer section of the refrigerator/freezer causes the water in the ice cube mold, which was filled with water during the latter stages of the operating cycle of the module, to freeze.

FIG. 12 additionally shows the exemplary assembly 150 of the various electrical circuits, traces and contacts and the switches 140, which may power and control the operation of the exemplary embodiment of control module 100 of FIGS. 8-17. The module 100, as shown in FIG. 12, includes a four pin male connector 159 which includes a ground trace contact pin 160, a water valve trace pin 170, a line trace contact pin 180 and a neutral trace contact pin 190. The male connector 159 is adapted to receive and electrically connect pins 160, 170, 180 and 190 to a mating female connector (not shown) of a power cord from the refrigerator/freezer to power the control module 100. A ground trace 162 is located adjacent to and electrically connected to the ground trace contact pin 160, and also to a ground trace receiver 164. A water valve trace 172 is located adjacent to and electrically connected to the water valve trace pin contact pin 170. A line trace 182 is located adjacent to and electrically connected to the line trace contact pin 180. A neutral trace 192 is located adjacent to and electrically connected to the neutral trace contact pin 190.

These and other traces identified below generally are fixed within molded channels in the cover 104 of the housing 100, which can be seen extending along the sides of the traces in FIG. 12. Several traces have each been identified by the same reference number at more than one location within the cover for ease of understanding. Thus, the line trace 182, as viewed in FIG. 12, extends outwardly and upwardly from the line trace pin 180 to a line trace motor connector 184, where it is electrically connected to one lead (not shown) of the motor 110, and also extends inwardly from line trace pin 180 to a line trace receiver 186. The neutral trace 192 extends generally inwardly and then upwardly from the neutral trace pin 190, with a branch to the lower contact 144.2 of the motor switch 140*a*. The neutral trace 192 continues upward to the lower contact 144.7 of the bail arm switch 140*b*. A motor trace 194 extends upwardly from the upper contact 144.1 of the motor switch 140*a* and behind bail arm switch 140*b* to motor trace motor connection 196, where it is electrically connected to the other lead (not shown) of the motor 110. The motor trace 194 is also electrically connected to the middle contact 144.8 of the bail arm switch 140*b*. Accordingly, power may be supplied to the motor 110 by the line trace 182, and the neutral trace 192 via the motor switch 140*a* and the motor trace 194, or via the bail arm lever switch 140*b* and the motor trace 194.

Thermostat trace 155 connectively extends between the upper contact 144.6 of bail arm switch 140*b* and thermostat receiver 157. Heater trace 198 connectively extends between the middle contact 144.3 of the motor switch 140*a* and heater trace receiver 199. The heater trace 198 is also electrically connected to the thermostat receiver 156 and the middle contact 144.4 of the water fill switch 140*c*. The water valve trace 172 connectively extends from the water valve trace pin 170 to the lower contact 144.5 of the water valve switch 140*c*. Accordingly, power may be connectively supplied to the thermostat pin 158*b* engaged with the thermostat receiver 157, via bail arm switch 140*b* and thermostat trace 155, and to thermostat pin 158*a* connectively engaged within the thermostat receiver 156 via the neutral trace 192, motor switch 140*a* and heater trace 198. The heater (not shown) is connected between heater pin 200*a* engaged within the heater trace receiver 199, and heater pin 200*b* engaged within the line trace receiver 186. Heater pins 200*a* and 200*b* extend through openings in the rear surface of the housing 102 to engage the heater trace receiver 199 and line trace receiver 186 (as schematically shown in FIG. 12). Accordingly, power may be supplied to the heater when the thermostat is activated by the temperature sensor).

The electrical contact pins 158*a* and 158*b* of a conventional heat activated thermostat, during operation of the module 100, will extend into the module through housing pin openings 103, shown in FIG. 8, to engage electrical thermostat pin receivers 156 and 157 positioned within the cover 104 (as schematically shown in FIG. 12) to power the thermostat. The rear end of the thermostat has an exposed temperature sensor which is positioned within the freezer section in close proximity to the ice mold which is subject to freezing temperatures within the freezer section, and thawing temperatures from the heater. The sensor cools with the mold until it reaches a pre-determined temperature at which the water in the mold has frozen to form ice cubes. The thermostat will then activate the mold heater and the motor 110 of the control module 100, via a circuit path through contacts 144.6 and 144.7 of the bail arm switch 140*b*, and thermostat trace 155, to initiate the operating cycle of the control module 100 and the automatic ice maker, and begin rotation of the cam gear 121 away from its home position shown in FIG. 8.

FIG. 9 is a rear interior plan view of the cover 104 of the partially assembled control module 100 of FIG. 8, wherein the opposite face of the earn gear 121 and bail wire lever 131 are shown in their home positions illustrated in FIG. 8.

Figure 10:
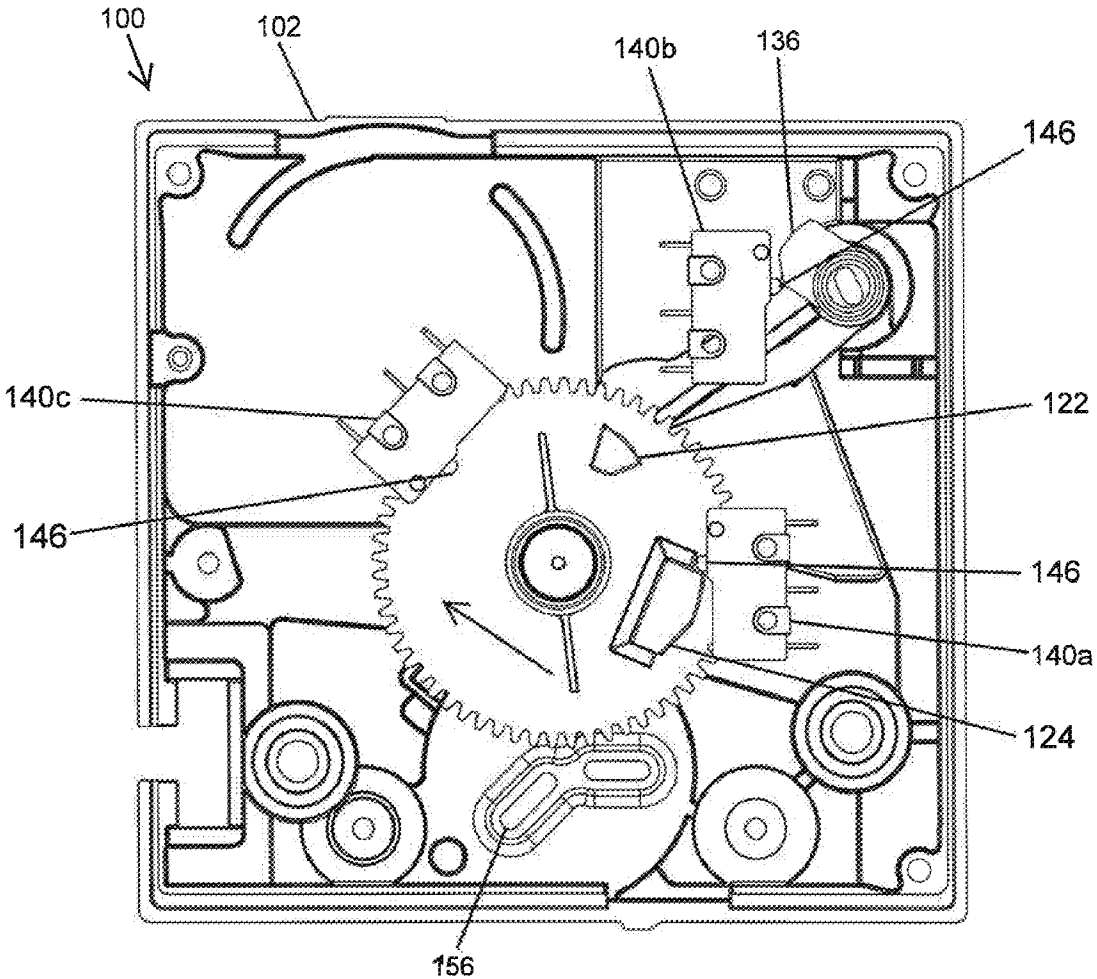
FIG. 10 is a front plan view of a partially assembled control module housing according to an exemplary embodiment wherein certain components of the module are shown in position after disengagement of the motor switch.

FIG. 10 is a front interior plan view of the control module of FIG. 8 wherein the moving motor switch cam 124 has just passed and released button plunger 146 of motor switch 140*a* to re-establish a direct line-to-neutral electrical current path through contacts 144.1 and 144.2 of motor switch 140*a* and the motor 110 (not shown), which continues to rotate the cam gear at a very slow constant speed. In an exemplary embodiment, the motor 110 will run at a speed of one RPM, and the cam gear will complete its 360° cycle in three minutes. As the earn gear continues to rotate clockwise as shown by the arrow in FIG. 10, the thermostat will reach a temperature which indicates that the heating element has produced enough heat within the mold to free the ice cubes from their mold pockets. The thermostat then shuts off, terminating current to the heating element, and also to the motor 110, which continues to operate on power supplied directly through motor switch 140*a*.

FIG. 5 illustrates the position of the cam gear 121 when the third projection 123, also sometimes referred to as the cam gear bail wire lever cam, reaches and engages the bail wire lever 131, which has remained in its home position during the first approximately 180 degrees of rotation of the cam gear. In normal operation, the projection 123 causes the bail wire lever 131 to begin to pivot and move to the position shown in FIG. 12, at which point the bail arm lever switch cam 136, which is integral with and pivots with the bail wire lever 131, has pivoted to depress button plunger 146 on the bail arm lever switch 140*b*, to thereby open the previously existing circuit path through contacts 144.6 and 144.7 of that switch to the thermostat trace 155, and thereby inactivate the thermostat. The cam gear 121 continues its constant speed rotation, causing the bail wire lever 131 to reach its fully pivoted position as shown in FIG. 14. As the bail wire lever 131 pivots about its hub, the bail wire end 135 keyed within the hub portion 137 of the bail wire lever 131, and the attached bail portion (not shown) of the wire bail arm, pivot from a lower ice sensing position to an upper position to allow the free flow of ice from the mold to an underlying ice receptacle in the freezer compartment in a conventional manner. While the wire bail arm 135 is in its elevated position, a conventional ice ejection apparatus (not shown), having a drive shaft coupled to the hub of the cam gear 121 whereby rotation of the cam gear 121 causes similar rotation of the ejection apparatus, reaches the ice cube ejection step in its rotation. Projecting fingers of the rotating ejection apparatus are then driven by the drive shaft through the ice maker mold to eject the frozen ice cubes from the mold into the ice reservoir.

After the ice cubes have been ejected from the mold, the next step of the exemplary cycle is the water fill step. FIG. 13 shows the first cam gear projection 122, which in exemplary embodiments functions as the water fill switch cam, as it initially engages button plunger 146 of water fill switch 140*c* to close a circuit through contacts 144.4 and 144.5 of that switch and the water fill trace 172 and water valve contact pin 170 and activate'a water pump or valve of the automatic ice maker to initiate the flow of water to the ice cube tray. Current is supplied to closed contact 144.4 of the water fill switch 140*c* via motor trace 194, contacts 144.8 and 144.6 of switch 140*b*, thermostat trace 155, the thermostat and heater trace 198. Closure of the circuit by the water fill switch 140*c* thus repowers the cold thermostat to complete the water fill circuit. The length of the cam surface of the projection 122, which engages and depresses the pin or button plunger 146, will be dependent upon both the speed of rotation of the cam gear 121 and the water flow rate delivered by the water pump or valve, such that the desired amount of water will be delivered to the water tray during the period that the pin or button plunger 146 of switch 140*c* is depressed by the passing cam surface of water fill switch cam 122. As indicated by the illustrated size of the cam 122, the water fill step is completed during a relatively short period during the 360 degree full cycle revolution of the cam gear 121. FIG. 15 shows the position of the cam gear 121 when the cam 122 disengages from the button plunger 146 of switch 140*c* to deactivate the water pump or valve and terminate the water fill step, and also once again deactivates the thermostat.

The next step of the cycle is the disengagement of the button plunger 146 of the bail arm switch 140*b*. FIG. 16 shows the position of the cam gear 121 and third projection 123 on the rear side of the cam gear at the point where the trailing end of the cam 123 has passed the end of the pivoted bail wire lever 131. At this point in the revolution of the cam gear 123, the bail wire return spring 138, best shown in FIG. 1, returns the bail wire lever 131 to its home position illustrated in FIG. 16. Simultaneously, the bail arm lever switch cam 136, which in exemplary embodiments is integrally formed with the bail arm lever 131, has pivoted away from the button plunger 146 of switch 140*b* to return the switch to its original normal position and once again activates the thermostat. The motor 110 and cam gear 121 then complete their rotation cycle at which time the motor switch cam 124 engages the button plunger 146 of motor switch 140*a* and shuts off power to the motor and the cam gear 121 stops at its home position, as shown in FIGS. 8 and 9. The unit then stays at the home position until the thermostat ice temperature sensor once again gets cold enough to close and supply power to the heater, and the motor 110, which begins rotation to start the automatic ice cube ejection water fill cycle once again.

Figure 17:
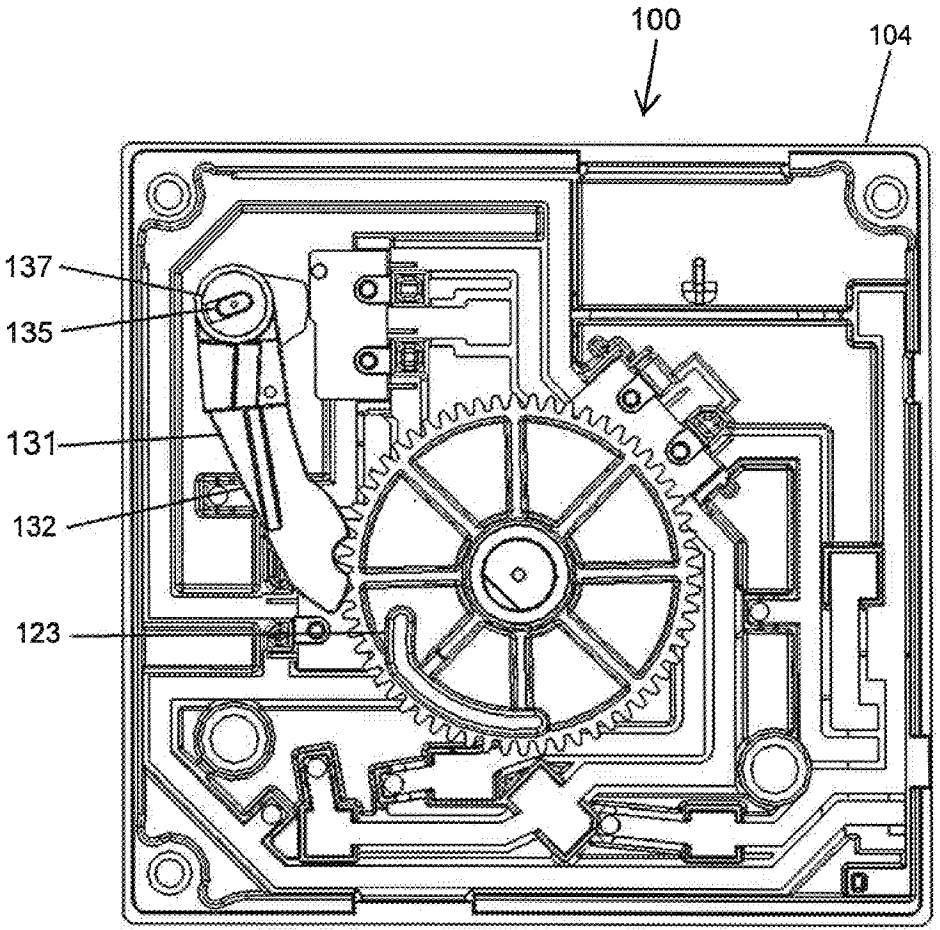
FIG. 17 is a rear plan view of the cover of a partially assembled control module showing the cam gear in its home position and the bail wire lever remaining in its fully extended ice detecting position maintaining engagement with the bail arm lever switch according to a second exemplary embodiment.

FIG. 17 illustrates the condition which is reached when the ice cubes in the ice receptacle of the automatic ice maker within the freezer section of the refrigerator/freezer have reached the level at which the wire bail arm 135 which extends from the hub 137 of the bail wire lever 131 detects ice in the upper portion of the ice receptacle. As the level of the ice cubes ejected from the ice tray into the ice receptacle reaches and exceeds the home position level of the wire bail arm, the ice cubes will eventually prevent the return spring 138 from returning the bail wire lever 131 to its home position shown in FIG. 9. It can be seen from FIG. 17 that so long as the bail arm 131 remains in its fully pivoted position the bail arm lever switch cam 136 will continue to depress the button plunger 146 (not visible in FIG. 17) to retain switch 140*b* in a position wherein power is cut off to the thermostat when the water fill switch 140*c* is open. Accordingly, under such conditions, the motor will drive the gear cam 121 to its home position as indicated in FIG. 17, the water delivered to the ice mold will freeze into cubes, but the next automatic ice cube ejection and ice making cycle will not be initiated by the thermostat until the level of ice cubes within the ice receptacle recedes or is otherwise emptied to a level which permits the wire bail arm 135 and coupled bail wire lever to freely be driven back to their home positions by the return spring 138, and the button plunger 146 of the bail arm lever switch 140*b* is released to complete a circuit through the thermostat via contacts 144.6 and 144.7.

Figure 18:
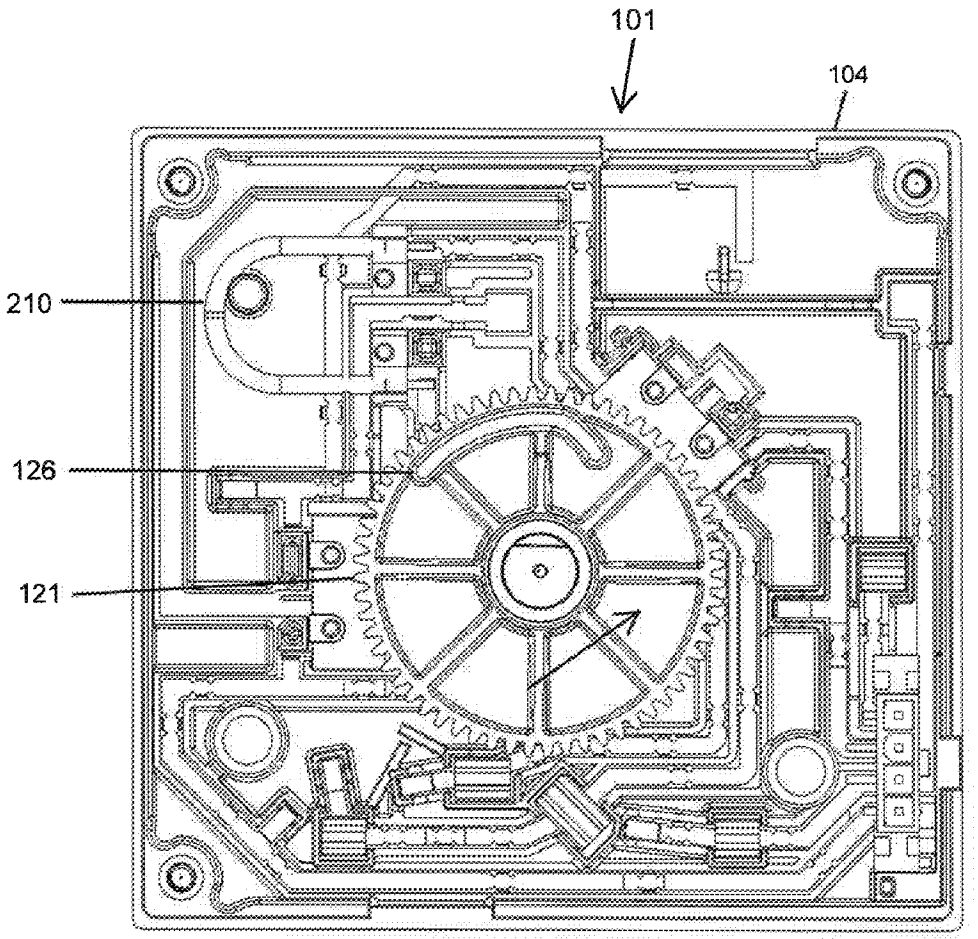
FIG. 18 is a rear plan view of the cover of a partially assembled control module and selected components according to a fourth exemplary embodiment.

FIG. 18 illustrates an additional exemplary embodiment of a control module 101, for use with a refrigerator/freezer that has its own remote sensor that detects for ice level and will shut off power to the thermostat of the control module 101 when the ice cubes in the ice receptacle reach the "full" level. Accordingly, control module 101 includes a conductor 210 as an alternative to the bail arm lever switch 140*b* of the previously described control module 100. Conductor 210 completes the power circuit to the thermostat, unless the refrigerator sensor has shut off the power to the control module 101 or the thermostat. In addition, control module 101 does not include a bail wire lever similar to previously discussed bail wire lever 131. As a result, the third projection 126 shown on cam gear 121 in FIG. 18 does not engage a bail wire lever 131 to control a wire bail arm 130, and in fact is not operative in control module 101. Thus, although FIG. 18 shows projection 123, such projection could be eliminated from the cam gear 121 used with the illustrated control module 101, if desired or economically beneficial. In exemplary embodiments, the remaining components of control module 101 shown in FIG. 18 can operate substantially identically to previously described exemplary embodiments of control module 100, unless power to the unit is shut off by the refrigerator/freezer ice sensor.

It should be appreciated that the first projection 122, second projection 124 and third projection 123 or 126 may interact with switches 140 located adjacent to their paths of travel that operate various other elements of the automatic ice maker, as may be desired.

Likewise, it should be appreciated that the above-outlined ejection apparatus may be any known or later-developed ejection apparatus usable to transfer the ice cubes from the mold to an ice reservoir for storage and/or dispensing. In various exemplary embodiments, the ejection apparatus includes a series of fingers extending from a rotatable shaft. As the shaft is rotated (c.g., by engagement within cam gear hub 125 driven by electric motor 110), the fingers push the ice cubes out of the convex mold cavities and into the ice reservoir. In various other exemplary embodiments, the ejection apparatus may be a mold shaft rotatable by motor 110, and gravity may be used to help transfer the ice cubes from the mold to the holding bin.

It should also be appreciated that, in various exemplary embodiments, the interaction between the above-outlined projections 122, 123, 124, 126 or 136 and the switches 140 is mechanical. That is, in various exemplary embodiments, the projections 122, 123, 124, 126 or 136 mechanically interact with the switches 140 as opposed to, for example, involving the movement of electrically conductive surfaces that meet and interact with each other.

As such, in various exemplary embodiments, there are no moving electrically interacting surfaces (e.g., electrical surfaces that only periodically interact) that may be subject to reduced reliability due to, for example, corrosion. It should be appreciated that any of the exposed electrically conductive surfaces may be covered or insulated to prevent or reduce corrosion. Likewise, it should be appreciated that, typically, any corrosion on a non-contact or non-moving conductive surface (e.g., a surface that, while electrically conductive, is not intended to only periodically make physical contact with another conductive surface) will not reduce the effectiveness of that surface. That is, the performance of the various electrical circuits, traces and/or contacts 150 shown in FIG. 1, may be largely unchanged regardless of the presence of any corrosion on an outer surface of those electrical circuits, traces and/or contacts 150, at least with regard to interactions with the cam gear 120.

It should also be appreciated that the various electrical circuits, traces and/or contacts 150 may take various desired forms. For example, the circuits, traces and/or contacts 150 may include a series of wires soldered to contact pads, a series of copper traces and/or a printed circuit board.

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The invention claimed is:

1. A control module for an automatic ice maker comprising:

a housing;

a cam gear rotationally supported within said housing and comprising:

a generally circular-shaped body having a first face and a second face; and at least one cam extending from the at least one of the first and second face;

at least one switch fixedly supported within the housing wherein each of the one or more switches is physically enclosed within a protective housing and has a movable actuator which actuator extends externally of the protective housing for interaction with at least one cam extending from a cam gear face; and wherein each of the at least one cam interacts with a one of the at least one switch of the control module to activate at least one feature of the control module during a rotation of the cam gear.

2. The cam gear of claim 1, wherein the at least one cam extending from the first face comprises at least a first cam and a second cam.

3. The cam gear of claim 2, wherein the first cam and the second cam each have interaction surfaces that interact with at least one of the at least one switch of the control module during rotation of the cam gear.

4. The cam gear of claim 3, wherein the interaction surfaces of the first cam and the second cam are provided at different elevations from the first face of the cam gear.

5. The cam gear of claim 1, wherein at least one of a shape and a size of the at least one cam relates to a desired length of activation of the at least one feature of the control module.

6. The cam gear of claim 1, further comprising:

at least one cam extending from the second face, wherein the at least one cam extending from the second face interacts with at least one switch of the control module to activate at least one feature of the control module.

7. A control module for an automatic ice maker comprising:

a housing;

a cam gear rotationally supported within said housing and comprising:

a generally circular-shaped body having a first face and a second face;

at least one cam extending from the first face;

at least one switch fixedly supported within the housing;

wherein the at least one cam interacts with the at least one switch of the control module to activate at least one feature of the control module during a rotation of the cam gear;

at least one cam extending from the second face;

wherein the at least one cam extending from the second face interacts with at least one switch of the control module to activate at least one feature of the control module; and wherein the at least one cam extending from the first face interacts with a first switch of the control module and the at least one cam extending from the second face interacts with a second switch of the control module at defined moments during a rotation of the cam gear.

8. The cam gear of claim 7, wherein each of the at least one cam extending from the first face and each of the at least one cam extending from the second face have independent paths of travel as the cam gear rotates.

9. A control module for an automatic ice maker comprising:

a housing;

a cam gear rotationally supported within said housing and comprising:

a generally circular-shaped body having a first face and a second face; and at least one cam extending from the first face;

at least one switch fixedly supported within the housing;

wherein the at least one cam interacts with the at least one switch of the control module to activate at least one feature of the control module during a rotation of the cam gear; and wherein the at least one cam extending from the first face comprises a first cam and a second cam extending from the first face, the cam gear further comprising a third cam extending from the second face, wherein:

the first cam and the second cam extend from the first face to different elevations from the first face;

the first cam, second cam and third cam each interact with a first switch, second switch and third switch, respectively, of the control module to activate that switch;

the first switch, second switch and third switch each control operation of a at least one different feature of the control module; and at least one of the size and shape of the first cam, second cam and third cam corresponds to a desired length of activation of the corresponding switch.

10. A control module for an automatic ice maker comprising:

a housing;

a cam gear rotatably supported within the housing and comprising:

a generally circular-shaped body having a first face and a second face; and at least one cam extending from the first face;

a constant speed electric motor supported within the housing and adapted to selectively rotate the cam gear at a constant low speed through a complete rotation of 360 degrees;

at least one switch fixedly enclosed within a protective housing within the control module housing;

wherein each of the one or more switches has a movable actuator which actuator extends externally of the protective housing for interaction with at least one cam extending from a cam gear face to activate the associated switch; and wherein the at least one cam of the cam gear interacts with the at least one switch to sequentially energize and de-energize the motor, and activate or deactivate at least one feature of the automatic ice maker selected from at least one of the features of filling an ice mold with water, and energizing a thermostat to power at least one of the motor and an ice tray heater.

11. The control module of claim 10, further comprising at least one cam extending from the second face of the cam gear, wherein the at least one cam extending from the second face of the cam gear interacts with the movable actuator of at least one of the at least one switch of the control module to activate at least one feature of the automatic ice maker.

12. The control module of claim 11, further comprising a lever pivotally mounted in the housing that interacts with the at least one cam extending from the second face, the lever having a projection to operatively engage the movable actuator of the at least one switch of the control module as the lever is pivoted by engagement with the cam of the rotating cam gear to control at least one feature of the automatic ice maker selected from the features for sequential energizing.

13. The control module of claim 12, wherein the lever is a bail arm lever pivotally mounted in the housing, and includes structure for engaging and rotating a bail arm extending outwardly from the control module housing as the bail arm lever is pivoted by engagement with the at least one cam that interacts with the lever.

14. The control module off claim 10, wherein the cam gear has a hub portion, and the hub portion is accessible through the wall of the housing to engage and rotate a rotatable ice ejection apparatus of the automatic ice maker when the cam gear is rotated by the motor.

15. A method of freezing ice utilizing a control module having a housing, the method comprising:

activating a motor mounted within the control module housing;

rotating a cam gear around a central axis within the housing, the cam gear having a generally circular-shaped body with a first face and a second face and at least one cam extending from the at least one of the first and second face;

activating one or more switches located substantially within protective housings fixedly located within the control module housing, said one or more switches corresponding to one or more features of the control module at one or more periods during the rotation of the cam gear;

wherein each of the one or more switches has a movable actuator which actuator extends externally of the protective housing for interaction with at least one cam extending from a cam gear face to activate the associated switch.

16. The method of claim 15, wherein activating one or more switches comprises the one or more cam interacting with the movable actuator of the one or more switch to activate that switch.

17. The method of claim 15, wherein activating one or more switches of the control module comprises the one or more cam interacting with a lever pivotally mounted on the housing of the control module to actuate the movable actuator of at least one of the one or more switches within the control module.

18. A method of freezing ice utilizing a control module having a housing, the method comprising:

activating a motor mounted within the control module housing;

rotating a cam gear around a central axis within the housing, the cam gear having a generally circular-shaped body with a first face and a second face and at least one cam extending from the first face;

activating one or more switches located substantially within protective housings fixedly located within the control module housing, said one or more switches corresponding to one or more features of the control module at one or more periods during the rotation of the cam gear;

wherein the cam gear comprises two cams extending from the first face and a third cam extending from the second face and activating one or more switches of the control module comprises activating three switches of the control module.

* * * * *

UNITED STATES PATENT AND TRADEMARK OFFICE

CERTIFICATE OF CORRECTION

PATENT NO. : 8,381,535 B2
APPLICATION NO. : 12/763571
DATED : February 26, 2013
INVENTOR(S) : Rybaski et al.

It is certified that error appears in the above-identified patent and that said Letters Patent is hereby corrected as shown below:

In the Specification

In Column 2, Line 36, delete "at leak" and insert -- at least --, therefor.

In Column 7, Line 49, delete "can gear" and insert -- cam gear --, therefor.

In Column 8, Line 35, delete "may 135" and insert -- 135 may --, therefor.

In Column 11, Line 5, delete "housing 100," and insert -- housing 102, --, therefor.

In Column 12, Line 6, delete "earn gear" and insert -- cam gear --, therefor.

In Column 12, Line 17, delete "earn gear" and insert -- cam gear --, therefor.

In Column 14, Line 13, delete "wire bail arm 130," and insert -- wire bail arm 135, --, therefor.

In Column 14, Line 34, delete "(c.g.," and insert -- (e.g., --, therefor.

In the Claims

In Column 15, Line 32, in Claim 1, delete "with a one" and insert -- with one --, therefor.

In Column 16, Line 37, in Claim 9, delete "of a at least" and insert -- of at least --, therefor.

In Column 17, Line 22, in Claim 14, delete "off claim" and insert -- of claim --, therefor.

Signed and Sealed this
Twelfth Day of November, 2013

Teresa Stanek Rea

Teresa Stanek Rea
*Deputy Director of the United States Patent and Trademark Office*